US008870306B2

(12) United States Patent
Simon

(10) Patent No.: US 8,870,306 B2
(45) Date of Patent: Oct. 28, 2014

(54) HOSPITALITY ENVIRONMENT ITEM AND METHOD OF ASSEMBLY

(76) Inventor: Lee Simon, Tampa, FL (US)

( * ) Notice: Subject to any disclaimer, the term of this patent is extended or adjusted under 35 U.S.C. 154(b) by 16 days.

(21) Appl. No.: 13/337,782

(22) Filed: Dec. 27, 2011

(65) Prior Publication Data

US 2012/0169192 A1 Jul. 5, 2012

Related U.S. Application Data

(60) Provisional application No. 61/428,223, filed on Dec. 29, 2010.

(51) Int. Cl.

| | |
|---|---|
| ***A47B 97/00*** | (2006.01) |
| ***A47B 88/00*** | (2006.01) |
| ***A47B 96/20*** | (2006.01) |
| ***A47B 95/00*** | (2006.01) |

(52) U.S. Cl.

CPC ..... *A47B 96/20* (2013.01); *A47B 95/00* (2013.01)

USPC ..... 312/204; 912/348.4

(58) Field of Classification Search

USPC ..... 312/348.1–348.4, 204, 228, 237, 236, 312/229, 352, 294

See application file for complete search history.

(56) References Cited

U.S. PATENT DOCUMENTS

| | | | | | |
|---|---|---|---|---|---|
| 3,773,399 | A * | 11/1973 | Sulcek | 312/204 |
| 3,877,765 | A * | 4/1975 | Hassing | 312/265.4 |
| 4,002,383 | A * | 1/1977 | Holloway, Jr. | 312/209 |
| 4,732,431 | A * | 3/1988 | Mason | 312/109 |
| 4,783,945 | A * | 11/1988 | Heeg | 52/656.4 |
| 5,139,322 | A * | 8/1992 | Aisley | 312/351 |
| 5,358,326 | A * | 10/1994 | Cherry et al. | 312/405 |
| 5,520,453 | A * | 5/1996 | Aoki et al. | 312/406 |
| 6,658,677 | B2 * | 12/2003 | Paul | 5/280 |
| 2003/0205953 | A1 * | 11/2003 | Fox | 312/216 |
| 2004/0065313 | A1 * | 4/2004 | Thompson | 126/37 R |
| 2008/0203869 | A1 * | 8/2008 | Mallory | 312/245 |
| 2008/0264090 | A1 * | 10/2008 | Sowa et al. | 62/344 |
| 2009/0224637 | A1 * | 9/2009 | Moon et al. | 312/109 |
| 2010/0254125 | A1 * | 10/2010 | Jones et al. | 362/227 |
| 2010/0270901 | A1 * | 10/2010 | Kim et al. | 312/405 |
| 2010/0314413 | A1 * | 12/2010 | Jones et al. | 222/173 |
| 2011/0084164 | A1 * | 4/2011 | Lee | 244/118.5 |
| 2011/0215199 | A1 * | 9/2011 | Lee | 244/118.5 |

* cited by examiner

*Primary Examiner* — Darnell Jayne
*Assistant Examiner* — Timothy M Ayres
(74) *Attorney, Agent, or Firm* — Hess Patent Law Firm LLC; Robert J. Hess

(57) ABSTRACT

A hospitality environment item, namely, interchangeable decorative panels that include laminates and their placement on underbar furniture/equipment. The decorative panels may each have their own laminate finish. Flanges attached to the underbar furniture/equipment extend to conceal edges of the decorative panels and extend over a peripheral region of the face of the decorative panel. The decorative panels have holes arranged to allow draw-pull handles to be secured to a drawer/door and a lock to penetrate into the drawer/door. Other decorative panels have holes that allow light to shine through from lights in backsplash sections.

24 Claims, 14 Drawing Sheets

HOSPITALITY ENVIRONMENT ITEM AND METHOD OF ASSEMBLY

CROSS-REFERENCE TO COPENDING PATENT APPLICATIONS

The present application claims the benefit of priority from U.S. provisional patent application Ser. No. 61/428,223 filed Dec. 29, 2010.

BACKGROUND OF THE INVENTION

1. Field of the Invention

The present invention relates to a hospitality environment item, such as interchangeable finish materials and their placement on underbar furniture/equipment in a commercial hospitality environment. The edges of the finish material are positioned to conceal their edges.

2. Discussion of Related Art

Commercial foodservice underbar furniture/equipment has traditionally featured limited or no options for aesthetic integration with the commercial hospitality environment. Stainless steel is the dominant material of choice, with little variation in look, material, or design. Black powder coated finish is sometimes available for rust-prone legs of exposed furniture/equipment, but it is perceived as a lower quality product and finish vs. the stainless steel option. In today's market, bar areas within commercial foodservice facilities are increasingly visible to the guest. As a result, new furniture/equipment designs are required to better integrate the furniture/equipment with the adjacent counters, millwork, walls, and finishes. Designers are seeking new options in underbar furniture/equipment, which will allow for the design concept to extend into the equipment arena. In many instances, the current "standard" bar furniture/equipment is seen as an "obstacle" that must be overcome. While the industry has developed a variety of finish options for back bar refrigeration, including laminates, glass, stainless, and veneers, the need for aesthetic improvements to the underbar furniture/equipment has been overlooked.

Due to rapidly changing trends in design, facilities also require the ability to upgrade and/or alter the look and appearance of their furniture/equipment without having to fully replace the furniture/equipment itself, which would add unnecessary cost and waste. Thus a solution is required that will enable the end user (equipment operator) to reasonably interchange aesthetic components without requiring assistance from a person who is skilled in the art.

Standard or "buy out" underbar furniture/equipment manufacturers offer few options addressing the aesthetic options desired by designers. Conventional offerings do not allow for accommodation of integrated decorative finishes or components. Such modifications would require physical modifications to the bar furniture/equipment (i.e. cutting and welding) in the factory or in the field, and the final product would most likely fail to meet aesthetic requirements of the design team. Alternate designs must typically be custom fabricated and do not offer the ability for modifications in appearance or aesthetics following initial fabrication and installation. As a result, costs for such non-standard design solutions are higher and these improvements are often deleted from projects when their costs are determined to be unaffordable. Opportunities also exist for new configurations and styles of underbar furniture/equipment offering unique functions not presently available to commercial bar operators.

The present inventor, in cooperation with Supreme Metal, an underbar furniture/equipment manufacturer, incorporated the present invention into a line of underbar furniture/equipment featuring interchangeable, customizable finishes, hardware, fixtures, storage options and installation configurations, as a cost effective way to upgrade interior bar functionality and decor integration. The line was introduced under the tradename VISION Underbar Furniture and the content from the website http://show.restaurant.org/nra11/public/Contentaspx?ID=1108 reads as follows about the launch of the VISION Underbar Furniture line:

- Supreme Metal is proud to introduce VISION Underbar Furniture, the world's first underbar beverage assembly system designed specifically with front-of-house integration in mind.
- Display kitchens, and the theater that they provide, have revolutionized the guest dining experience over the past two decades. But while display kitchen spaces continue to evolve, similar advancements in bar design have been fairly limited—until now. The continued evolution in mixology has offered another opportunity for improved guest connection and interaction, but the traditional bar design still dominates the landscape and limits this potential. Simply stated, today's underbar equipment has little aesthetic value and discourages more engaging bar environments.
- VISION Underbar Furniture will change that. This line of underbar furniture offers the unprecedented opportunity to customize the look and feel of the underbar system. With a variety of finishes, fixtures, and hardware now available, operators and designers alike can easily customize their interior bar without having to resort to custom fabrication. VISION Underbar Furniture features full cabinet construction and offers modern, chic, impactful finish options for doors, drawers, backsplashes, and exposed fronts or sides. Even better, the finishes and hardware are interchangeable in the field, which will allow for affordable updates in the future. With these new design features, the arrival of display bars is finally here. The freedom to create more open and engaging bar designs now exists.
- But this system has focused on more than just looks alone. VISION Underbar Furniture has blended form with much improved function. New, thoughtful features are incorporated throughout the line. Such improvements include flexible door/drawer configurations, integrated backsplash lighting, provisions for common purveyor provided equipment, integrated locking covers, innovative storage modules, and much, much more. As part of our development process, we took a step back to re-think the typical interior bar environment and looked for opportunities to improve the guest and staff experience at every turn.
- It is our hope that VISION Underbar Furniture will fill a long-neglected need and provide industry operators and designers with new options to create more open, engaging, display bars. The bar, as they say, is now truly . . . open. We invite you to explore your VISION of what a bar environment can be.

The VISION Underbar Furniture line was entered in a Kitchen Innovations Award contest run by the National Restaurant Association that judges cutting-edge furniture/equipment from foodservice equipment manufacturers. According to their website at http://show.restaurant.org/nra11/public/Contentaspx?ID=750&sortMenu=108007:

- Selected by an independent panel of experts, the award recipients represent the most groundbreaking equipment on the market that will cut costs and improve productivity and food quality in restaurant operations.

Previous Kitchen Innovations award recipients have received national and international attention for their revolutionary products.

"Our previous Kitchen Innovations Award recipients have gained recognition as industry-leading manufacturers of foodservice equipment that significantly helps restaurant operator profitability and efficiency, so we are excited to see this year's award submissions," said David Gilbert, Chief Operating Officer of the National Restaurant Association. "Product innovation is an important driver toward restaurant sales growth and cost management. By identifying back-of-the-house equipment that is truly cutting edge, we hope to help the nation's nearly one million restaurants grow and succeed."

Award recipients will be showcased in the Kitchen Innovations Pavilion in its new central location on the exhibit floor. Throughout the four-day NRA Show, there are countless opportunities to interact with U.S. and international dealers, distributors and chain, multi-unit and independent operators, corporate decision-makers and news media during one-on-one, interactive demonstrations. All applications are judged by an independent, expert panel of industry leaders.

The Vision line of underbar furniture was one of twenty-two recipients of this prestigious Kitchen Innovations award for 2011 based upon the present invention's interchangeable, customizable finishes, hardware, fixtures, storage options and installation configurations, as a cost effective way to upgrade interior bar functionality and decor integration.

The present inventor was motivated to fill a long felt need in the underbar furniture/equipment industry by coming up with a functional line of underbar furniture/equipment that replaces conventional underbar furniture/equipment offering similar capabilities, general sizes, and comparable configurations (i.e. ice bins, blender stations, storage cabinets, etc.) but with any number of or all of the following improvements:

1. Interchangeable decorative panels for front doors.
2. Interchangeable decorative panels for sides of furniture/equipment, where exposed.
3. Interchangeable decorative panels integrated into the backsplash of the furniture/equipment.
4. Selection of unique and interchangeable top finishes including but not limited to tile, stainless steel (including textured stainless steel), bonded metal, solid surface, marble, granite, quartz-based stone, glass, frosted glass, and other such comparable materials typically utilized in commercial foodservice front-of-house applications. Bonded metal finish includes finishes such as, but not limited to, bonded aluminum, bonded bronze, bonded gold bronze, bonded nickel silver. Preferably, the choice of finish is approved by the National Sanitation Foundation.
5. Equipment can be physically connected at the sides, thus increasing stability, improving installation, and reducing cost as side panels will not be required for all furniture/equipment. Side panels will only be required where ends of furniture/equipment are exposed.
6. Selection of interchangeable hardware, including but not limited to door handles, drawer pulls, faucet styles, etc.
7. Common cabinet style body capable of receiving a variety of finishes and/or components for the following areas: top, backsplash, door material, door design/style, and handles.
8. Common (single) tops and backsplash segments up to approximately 10'-0" in length which can span multiple pieces of furniture/equipment.
9. Standard internal design capable of receiving doors and/or drawers based on the end user's needs and preference.
10. Independent pieces, capable of affixing and securing to one another.
11. Side panels to be separate, and only provided as required where visible. Side panels can be retrofitted as required.
12. Integrated lighting within backsplash.
13. Corner cabinets with rotating storage shelves below.
14. Rotating liquor storage cabinets.
15. Security covers designed to retract and store within the same footprint of the individual piece of furniture/equipment, eliminating the need for remote storage of these security covers.
16. Decorative liquor storage rail containment equipment.
17. Drawer options for glass rack storage, concealing the visibility of unsightly glass racks from the guest.
18. Integral support and coordination for soda gun supporting equipment and components in a thoughtful and aesthetically pleasing manner.
19. Integrated storage and placement for soda guns within the furniture/equipment.
20. Option for integral stainless steel base.
21. Alternate corner storage units to maximize underbar storage capacity.
22. Accommodations for vendor provided items, including but not limited to, soda system components, soap and detergent dispensing, etc.
23. Decorative panels designed to affix to furniture/equipment not always offered by bar equipment manufacturers (i.e. undercounter dish machines), thus allowing the bar equipment to better integrate with the bar furniture.

SUMMARY OF THE INVENTION

One aspect of the invention resides in an apparatus and method of assembly for a hospitality environment item, namely, interchangeable decorative panels that include finish materials and their placement on underbar furniture/equipment in a commercial hospitality environment. The decorative panels may each have their own finish, which includes, but not limited to tile, stainless steel (including textured stainless steel), solid surface, marble, granite, quartz-based stone, glass, frosted glass, and other such comparable materials typically utilized in commercial foodservice front-of-house applications.

The decorative panel may be retained to underbar furniture/equipment in a releasable manner. The decorative panel may be fibreboard (e.g., medium weight) sandwiched between two interchangeable finish materials each with their own finish to render them reversible. Such a decorative panel is reversible in the sense that either finish material may face outwardly with the other hidden facing the underbar furniture/equipment to which the decorative panel is retained. Thus, the two interchangeable finish materials may different with respect to their respective finish.

The decorative panel may have at least one through-going hole to accommodate the securement of handles to the surface of the underbar furniture/equipment where the surface is part of a drawer or door by allowing passage of either portion(s) of the handle, base(s) that extend from the handle, or a drawer pull. Alternatively, the decorative panel may have at least one through-going hole arranged to allow light to shine through from a light source where the surface of the underbar furniture/equipment is part of a backsplash section and the light source is supported by the backsplash section.

Flanges may conceal edges of the decorative panel. The flanges are bent so that a portion on one side of the bend may cover a portion of the face of the finish material or the decorative panel neighboring the edges and the other portion be secured to the underbar furniture/equipment. The decorative panel may be of uniform thickness or be recessed at its periphery to fit the dimension of the flanges.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE PREFERRED EMBODIMENT

Figure 1:
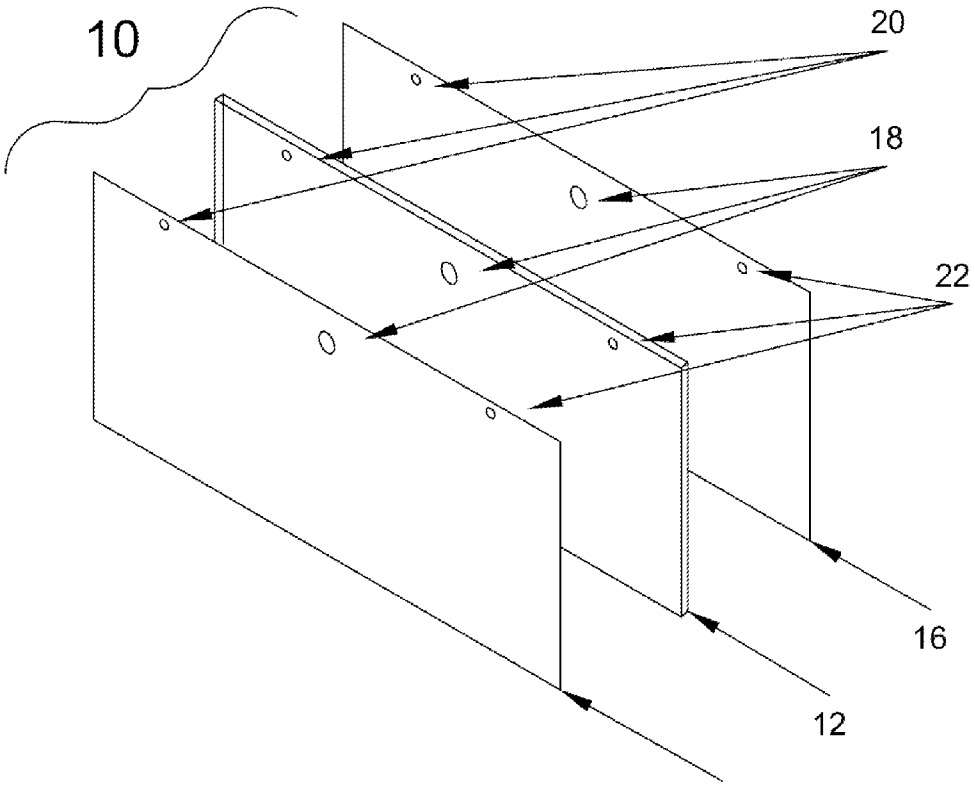
FIG. 1 is an exploded isometric view of a decorative panel in accordance with an embodiment of the invention that is reversible.

Turning the drawing, FIG. 1 shows a decorative panel 10 in accordance with the invention that is reversible. The decorative panel 10 includes a backing layer 12 of medium-density fibreboard sandwiched by two decorative laminate layers 14, 16. The two decorative laminate layers 14, 16 preferably differ in their respective décor—one may be a solid color and another may have a stone grain texture. Although two decorative laminate layers 14, 16 are depicted, they may instead be any kind of finish material and thus not necessary be limited just to laminate. For example, glass, granite and corian may be used instead of laminates as the finish material.

If desired, the decorative panel 10 need not be reversible, which means that one of the two laminates 14, 16 of FIG. 1 would be unnecessary and therefore may be removed so that the decorative panel is constituted by just one laminate (or other kind of finish material) and the fibreboard. Further, the fibreboard may be removed, leaving only one of the laminate layers 14, 16 (or other kind of finish material) to constitute the decorative panel.

The decorative panel 10 may have a rectangular face with two sets of opposite peripheral edges—one set being shorter than the other. The decorative panel 10 may have a hole 18 passing through that is arranged substantially equidistant from the opposite peripheral edges of the shorter of the two sets. The decorative panel 10 may also have pairs of further holes 20, 22 arranged substantially the same distance away from the opposite peripheral edges of the longer of the two sets. One of the further holes 20 of the pairs are spaced the same distance away from one of the opposite peripheral edges of the shorter of the two sets as the other of the further holes 22 of the pairs is spaced away from the other of the opposite edges of the shorter of the two sets. That way, the further holes of the pairs are in effect arranged in a symmetrical manner with respect to an imaginary line passing through the center of the hole 18 that extends substantially parallel to the opposite peripheral edges of the shorter of the two sets.

Such an arrangement allows either decorative laminate layer 14, 16 to face outwardly as desired by flipping the decorative panel 10 over relative to the underbar furniture/equipment to which it is secured with the other flipped over decorative layer in effect hidden when secured against a surface of the underbar furniture/equipment to which it is attached. The holes 18, 20, 22 allow for passage of handle bases or the like that are secured to the underbar furniture/equipment directly. The holes 18, 20, 22 may be formed in any conventional manner, such as during manufacture of the layers 12, 14, 16 in a mold, or after manufacture by drilling. Each decorative laminate layer 14, 16 has a finish whose type preferably may be either tile, stainless steel (including textured stainless steel), solid surface, marble, granite, quartz-based stone, glass, frosted glass, or other such comparable materials typically utilized in commercial foodservice front-of-house applications. Each decorative laminate layer may differ from each other as to type, thereby rendering reversible the decorative panel 10 so as to provide a different appearance.

Figure 2:
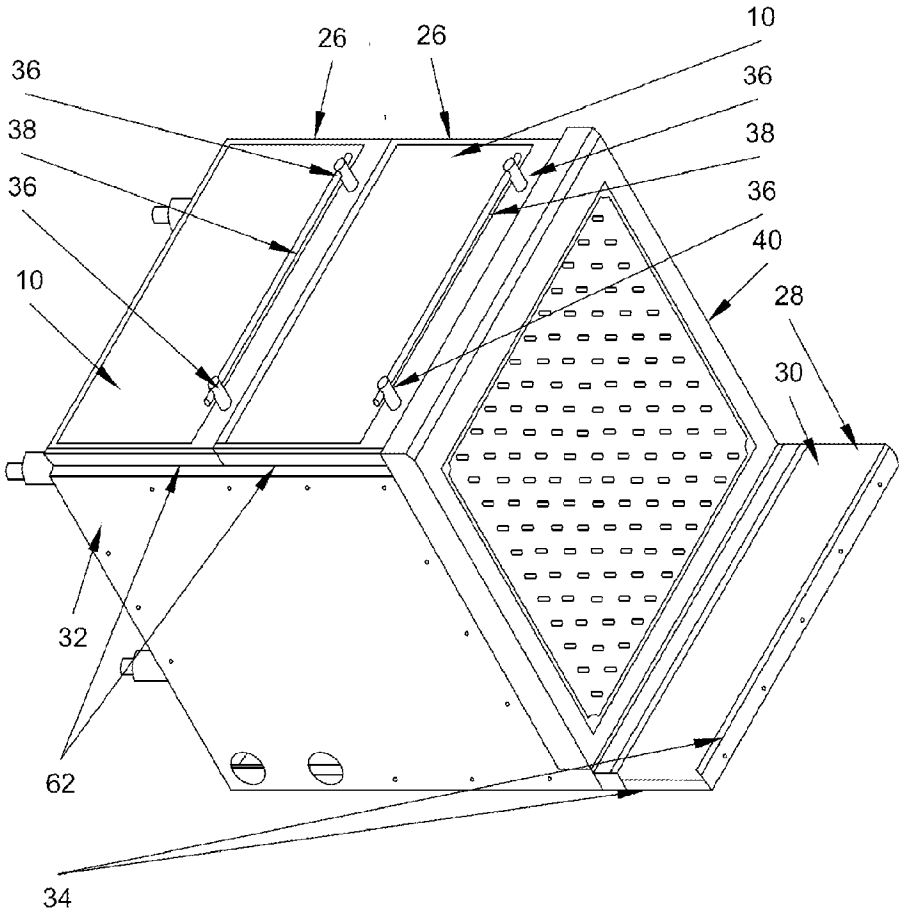
FIG. 2 is an isometric view of an underbar drain board two-drawer unit with the decorative panel of FIG. 1.

Turning to FIG. 2, underbar furniture is exemplified by a two-drawer unit 24 having doors 26 and a backsplash section 28. The two-drawer unit 24 may contain a drawer mounted ice bin. The decorative panels 10 for the doors 26 and decorative panels 30 for backsplash sections 28 may reside in a stainless steel frame 32 with means designed to conceal edges of the decorative panels 10, 30 from the visible side. Such means may be flanges 34 or an open frame 62 each having a lip part that extends over a peripheral region of the face of the decorative panels 10, 30. The same concealing and fastening technique is used for decorative panels placed on sides of underbar furniture/equipment units.

The decorative panels 10, 30, through removal of the set screws and L-shaped lock assembly 60 (see FIG. 8), can be readily removed by an end user and need not be removed by a skilled installer.

Figure 6:
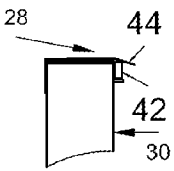
FIG. 6 is an enlarged view of a portion of a backsplash section from 6-6 of FIG. 5.
Figure 7:
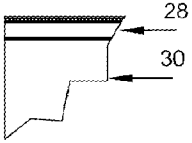
FIG. 7 is an enlarged view of a portion of the backsplash section from 7-7 of FIG. 4.

The decorative panels 10 preferably have pre-cut openings (cut-outs) where appropriate to accommodate passage of bases 36 of handles 38 on doors 26. A drain board 40 that is a perforated plate and rests in a recess on the top surface of the two-drawer unit 24. Turning to FIGS. 3-7, the decorative panels 30 preferably have pre-cut openings (cut-outs) where appropriate to accommodate passage of integrated light from lamps 42 of the backsplash sections 28, such as flat rope lights. A light shield 44 may be provided to extend over the top of the lamps 42 and somewhat forward as shown in FIG. 6 and may be equipped with a light reflective surface on its underside.

Figure 3:
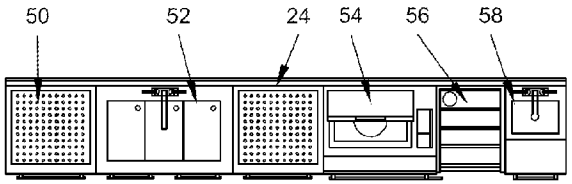
FIG. 3 is a top view of underbar furniture and equipment that has individual underbar units arranged adjacent to each other in succession all with the decorative panel of FIG. 1. The individual underbar units include a drain board, single-drawer unit, a multi-bowl sink, a drain board, two-drawer unit, a step liquor storage display unit, an ice bin with bottle wells and soda gun holder unit, and a hand sink storage unit.
Figure 4:
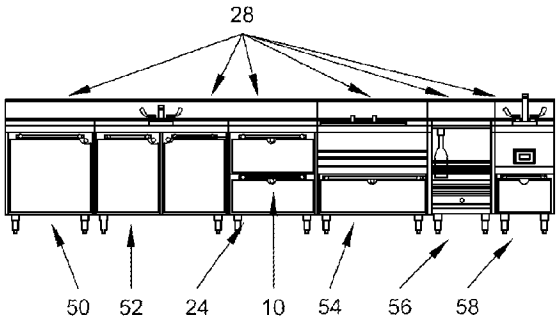
FIG. 4 is a front view of FIG. 3.
Figure 5:
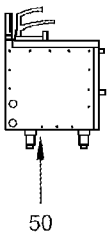
FIG. 5 is a side view of FIG. 3.

The decorative panels 10, 30 of the present invention may be incorporated into any of the following kinds of underbar furniture:

a. Ice Bin(s) with and without cold plate
b. Blender Station with and without dump sink
c. Step Liquor Storage/Display
d. Hand Sink with and without soap and towel dispenser
e. Drain Boards
f. Storage Cabinets
g. Bar Sinks
h. Beer Dispensers/Drainboards
i. Filler Boards and Panels
j. Equipment Stand
k. Wet/Dry Waste Cabinets FIGS. 3 and 4 show different kinds of underbar furniture/equipment, namely, a drain board, two-drawer unit 24, a drain board, single-door unit 50, a multi-bowl sink unit 52, a step liquor storage display unit 54, an ice bin with bottle wells and soda gun holder unit 56, and a blender station unit 59. The present invention envisions that any kind of underbar furniture/equipment may be arranged adjacent each other in succession, such as those of a-k mentioned in the previous paragraph. Whichever underbar furniture/equipment is at each end of such a successive line-up will have one side surface exposed to which may be provide a decorative panel of the present invention. All other side surfaces will be facing side surfaces of adjacent units and thus no decorative panel need be provided there since those side surface are in effect hidden by adjacent units.

As can be understood from FIGS. 3-7, each underbar furniture/equipment will have its own set of decorative panels to the extent it has a front surface and a backsplash section to which to secure the decorative panels. One or more of the decorative panels are secured to the front surface of the underbar furniture/equipment unit as applicable and one decorative panel is secured to the backsplash section.

In the case of the multi-bowl sink unit 52, it will be supported through the use of concealed structure, allowing for an under-counter mount design and incorporation of a variety of bar top materials as the bar top material will not be relied upon for structural support.

All decorative materials are compliant with NSF and food safety codes.

The frames may be fabricated of stainless steel, though other materials may be utilized instead.

Figure 8:
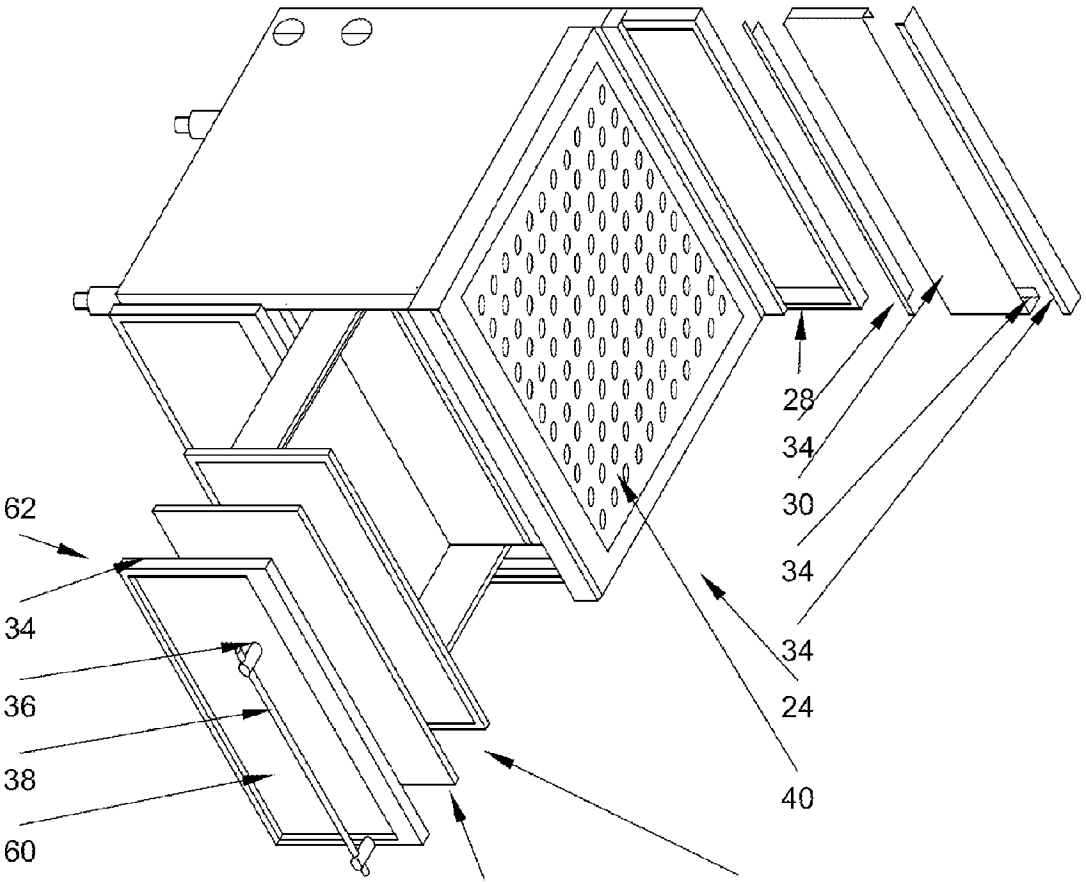
FIG. 8 is an exploded view of the underbar two-drawer storage cabinet of FIG. 2 that is also shown in FIGS. 3-4.

FIG. 8 is a disassembled view of the two-drawer unit 24 of FIG. 2. Two decorative panels 10 of FIG. 1 lies against the front surface of respective ones of the drawers 26. The aligned set of holes 18, 20, 22 align with corresponding aligned holes in the front surface as well as corresponding aligned holes in an open frame 62. A key lock assembly 60 has an end that penetrates through the aligned central openings 18 of the decorative panel 10 and an aligned hole in the front of the drawer 26 and an aligned central opening in the open frame 62, but has a flanged part spaced from that end that presses against the peripheral region of the aligned central opening of the open frame 62 when secured in position. Conventional locking arms (not shown) attached to the end of the lock assembly 60 from the inside of the drawers 26 to move in response to rotation of the lock between a locking position and an unlocking position in a conventional manner. Fasteners, not shown, pass through associated ones of further holes in the front of the drawers 26 to pass through aligned holes 20, 22 in the decorative panels and aligned holes in the open frame 62 to threadably engage into a threaded openings in the underside of the free ends of the bases 36 of the handles 38. The fasteners may be conventional screws whose stems fit through openings in the front of the drawer to threadably engage screw threads accessible from the free ends of the bases 36 of the handle 38, but whose heads are too large to fit through.

As concerns the backsplash section 28, flanges 34 are provided to secure to a frame of the backsplash section 28 and retain the decorative panel 30 in position. Each flange 34 has a bend between a connecting part and a lip part. The connecting part is secured to the frame in any conventional manner such as with fasteners. The connecting part, when secured, extends over an associated edge of the decorative panel 30 so that the lip part extends over a portion of the face of the decorative panel 30 neighboring the associated edge of the decorative panel 30. The frame of the backsplash section 28 is open to accommodate placement of a light source such as a lamp, which may likewise be secured to the frame of the backsplash section 28.

FIGS. 9-14 depict some examples of different kinds of underbar furniture/equipment all equipped with a backsplash that can accommodate the decorative panel 30 in the same manner as described for the drain board, two-drawer unit 24 of FIGS. 2 and 8. Where there are drawers/doors with a handle that is a drawer-pull, the decorative panel 10 may be incorporated in the same manner as described for the two-drawer unit 24 FIGS. 2 and 8.

Figure 9:
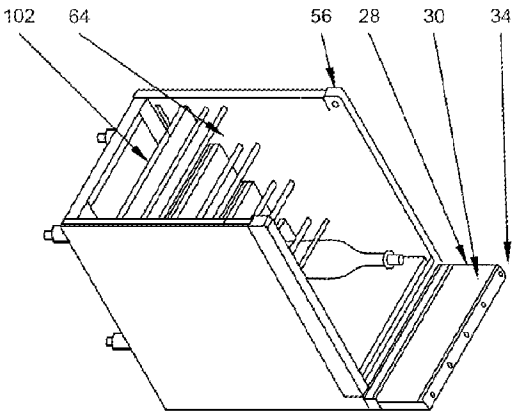
FIG. 9 is an isometric view of a step liquor storage/display unit shown in FIGS. 3-4 that includes the decorative panel of FIG. 1.
Figure 10:
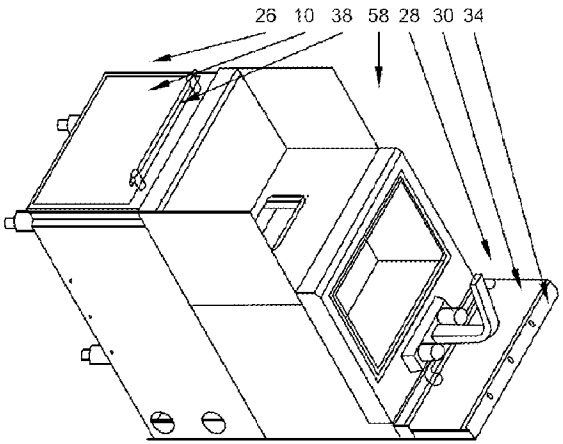
FIG. 10 is an isometric view of a blender station unit shown in FIGS. 3-4 that includes the decorative panel of FIG. 1.
Figure 11:
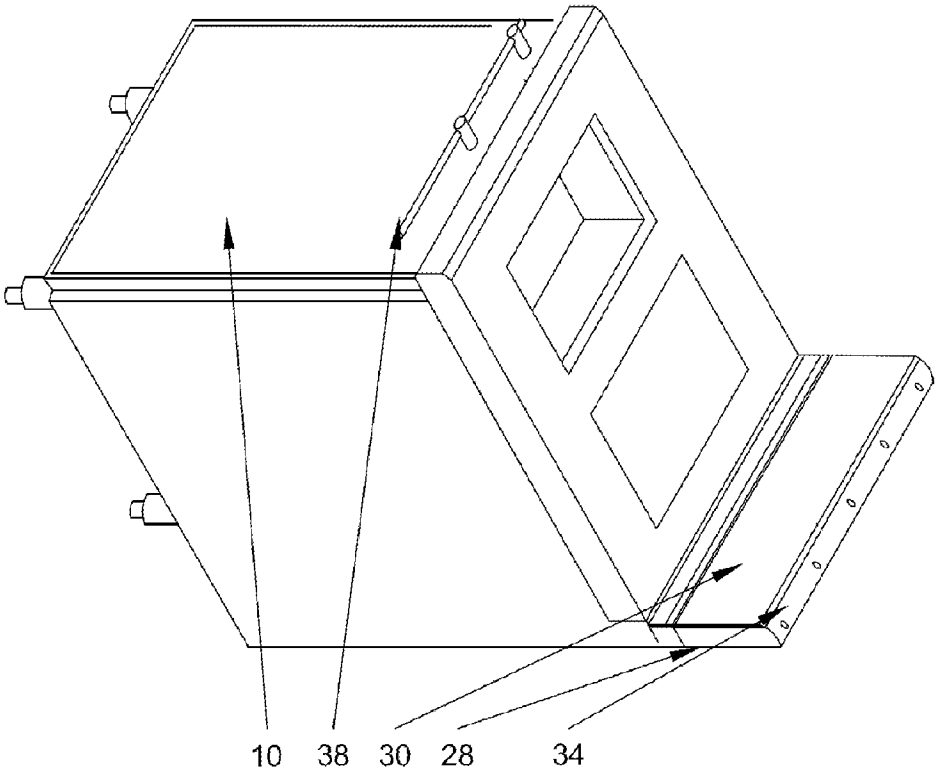
FIG. 11 is an isometric view of a trash unit that includes the decorative panel of FIG. 1.

As concerns the liquor stack display/storage unit 56 of FIG. 9, the cavity may accommodate placement of an "L" shaped hinged cover to be kept stored in the access cavity 64 of the unit and thus entirely within the footprint of the unit when not deployed. The "L" shaped hinged cover 102, when deployed, covers the otherwise accessible front and top of the liquor stack display/storage unit 56 and locks to secure the valuable liquor within the liquor stack display/storage unit. The front face of this "L" shaped hinged cover preferably has an interchangeable decorative panel (substantially the same as that of the decorative panel 10 of FIG. 1 but without the holes and of an appropriate dimension) incorporated to match the finish of the rest of the bar. When retracted and stored, this cover folds in half (about the hinge) and only the stainless ends are visible—so no decorative panel is visible at that time.

The interchangeable decorative panels make it easy to change the décor of the underbar furniture/equipment to suit desired themes or finish preferences. For instance, organizers of parties or special events that employ a desired color scheme in hospitality environments are now able, thanks to the interchangeable decorative panels, to give the underbar furniture/equipment a factory-finished look that blends in with the desired color scheme by simply choosing the desired finish for the decorative panels and switching the finish material layer in the existing decorative panel with another having the desired finish. Customized graphics or logos may be used for the finish material layer.

In addition, a decision may be made to alter the arrangement of the underbar furniture/equipment relative to each other, in which case, interchanging the finish materials easily would be handy. For example, if underbar furniture/equipment were arranged in a U or L shape, with each side having a different decorative panel color scheme so that collectively they convey some composite image, then switching around the underbar furniture/equipment would mixup the color schemes and thus the composite image. However, if their decorative panels were readily interchangeable with other decorative panels, then the overall composite image can be restored.

Figure 12:
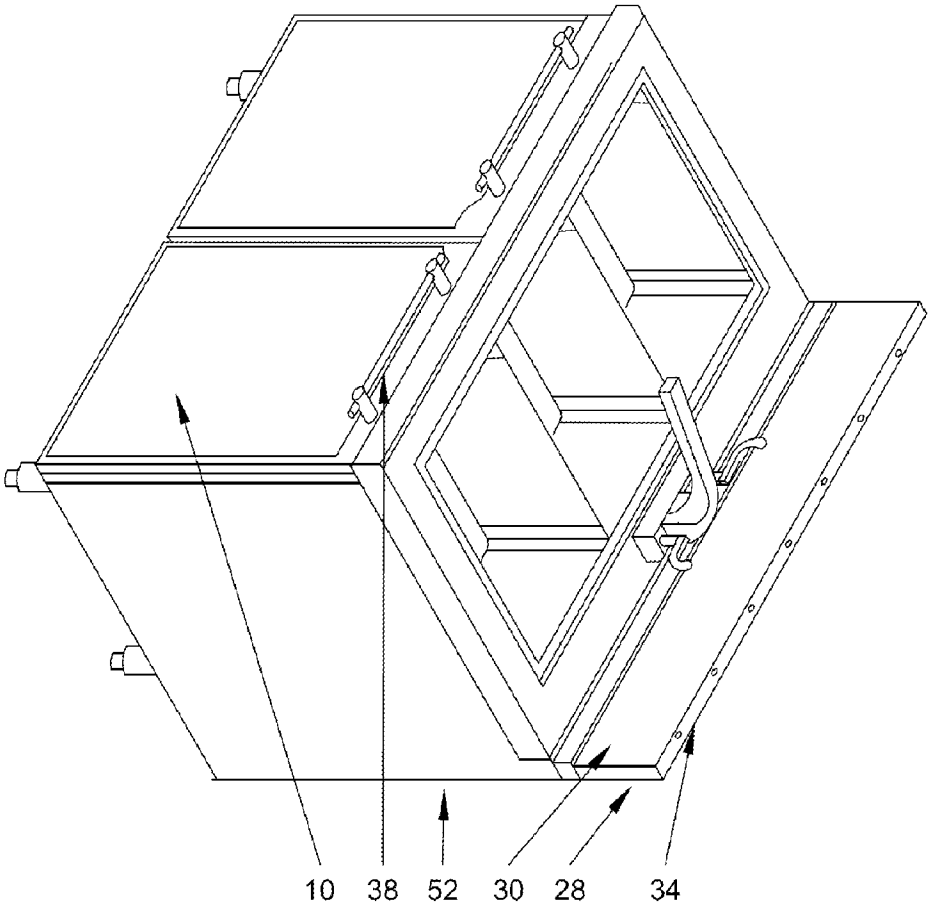
FIG. 12 is an isometric view of a multi-bowl sink shown in FIGS. 3-4 that includes the decorative panel of FIG. 1.
Figure 13:
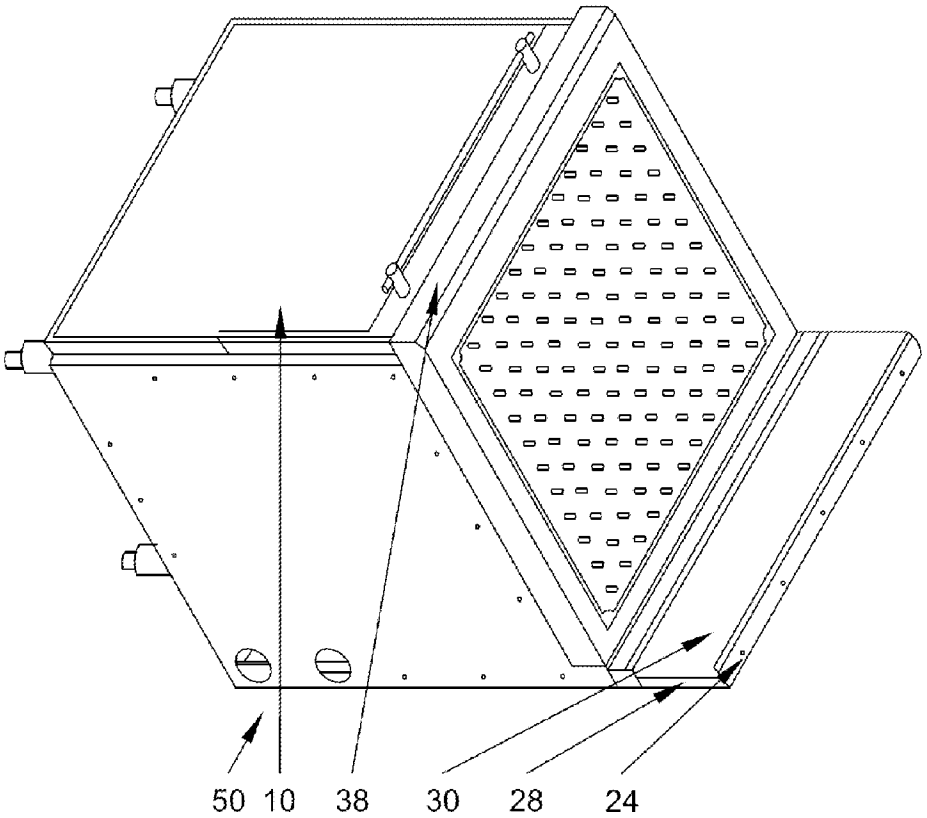
FIG. 13 is an isometric view of a drain board, single-door unit shown in FIGS. 3-4 that includes the decorative panel of FIG. 1.
Figure 14:
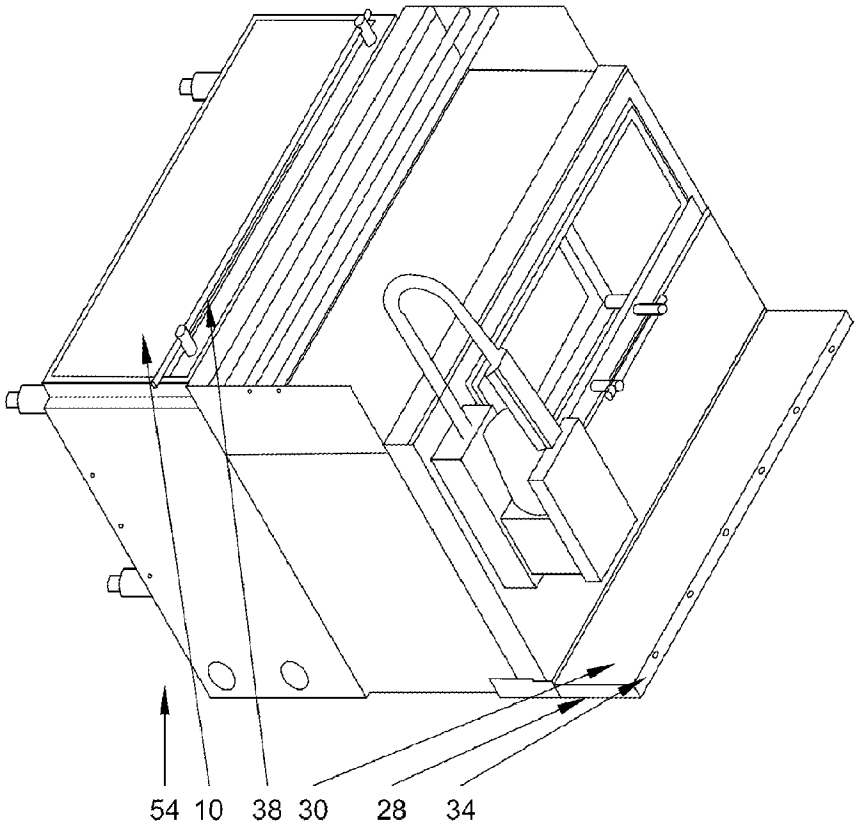
FIG. 14 is an isometric view of an ice bin with bottle wells and soda gun holder unit shown in FIGS. 3-4 that includes the decorative panel of FIG. 1.
Figure 18:
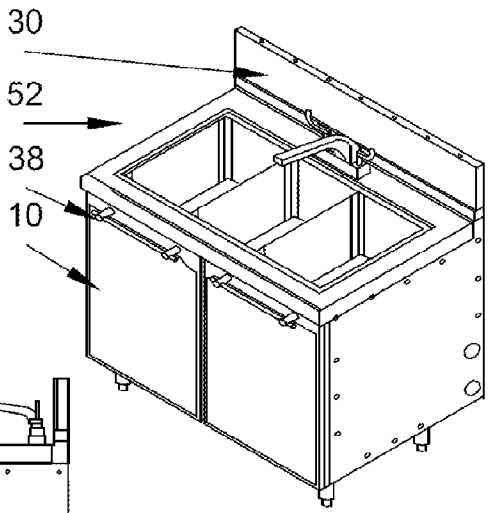
FIG. 18 is an isometric view of the views of FIGS. 15-17.
Figure 17:
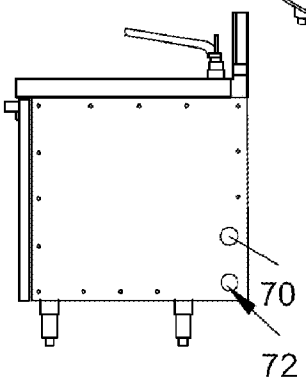
FIG. 17 is a right side view thereof that is symmetric to a left side view thereof.
Figure 15:
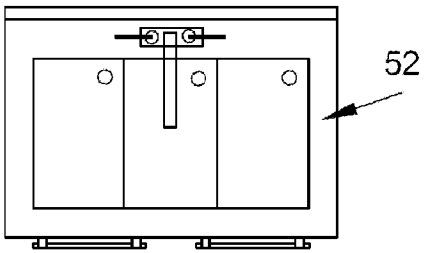
FIG. 15 is a top view of a multi-bowl sink similar to that of FIG. 12.
Figure 16:
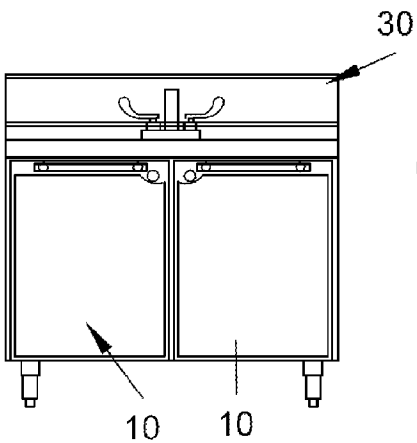
FIG. 16 is a front view thereof.
Figure 19:
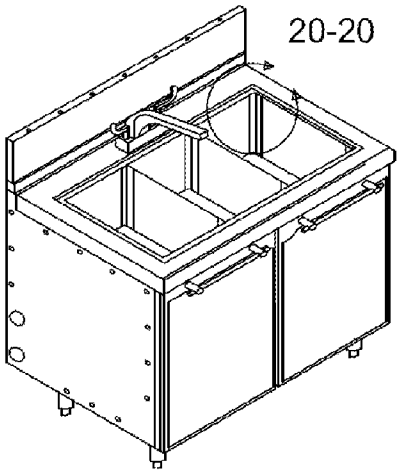
FIG. 19 is an isometric view of the top, front and left side thereof.
Figure 20:
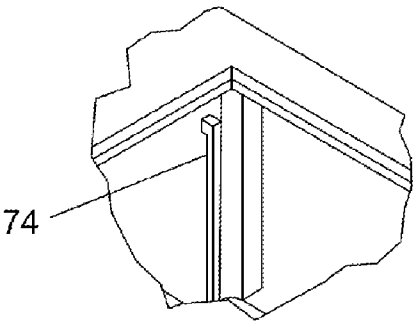
FIG. 20 is an enlargement of 20-20 of FIG. 19.
Figure 21:
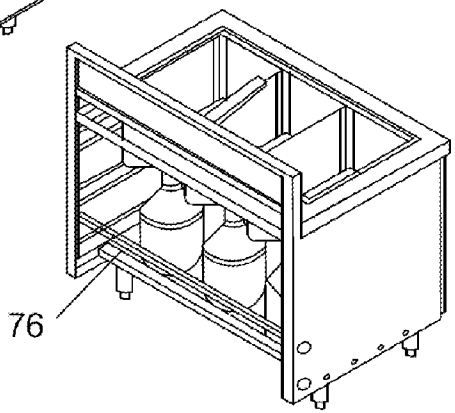
FIG. 21 is an isometric view of the top, rear and left side thereof.

Turning to FIGS. 15-21, the bar sink or multi-bowl sink 52 of FIG. 12, but with additional features. FIG. 17 shows two openings 70, 72 for water utility piping or tubing, one for water supply and the other for water drainage. FIG. 20 shows a soap, rinse and sanitizer dispenser tube assembly 74. FIG. 21 shows a rear compartment with bottom for supporting separate containers 76 that contain cleaning solutions. The dispenser tube assembly 74, which is equipped with a conventional manual pump actuator, dispenses cleaning solution into the multi-bowl sink 52 when actuated.

Figure 23:
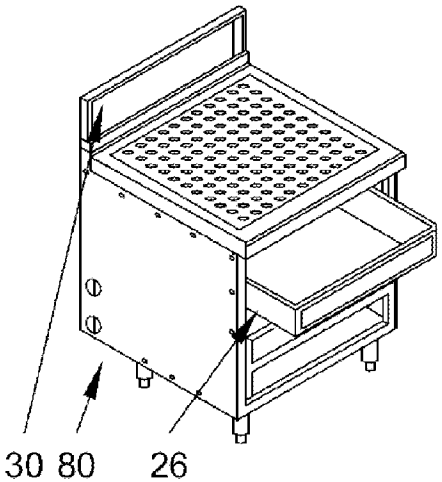
FIG. 23 is a further isometric view of the further embodiment of FIG. 22, but with the single door removed.
Figure 22:
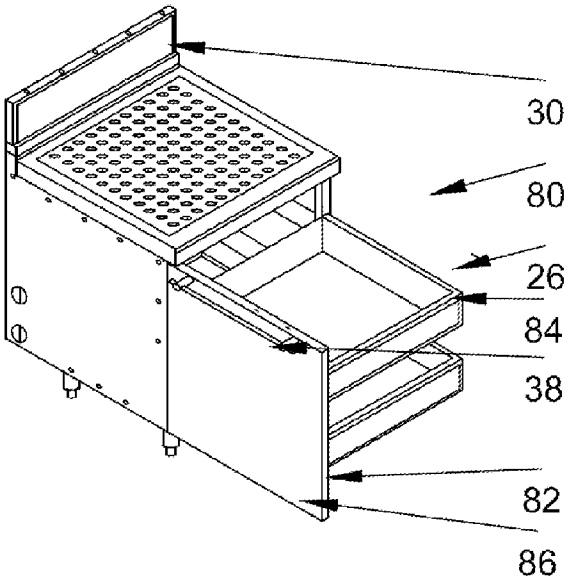
FIG. 22 is an isometric view of a further embodiment of a two-drawer unit having a single door.

Turning to FIGS. 22 and 23, a two-drawer unit 80 is shown that is substantially identical to the two-drawer unit 24 of FIGS. 2 and 8 with a backsplash decorative panel 30, except that the two-drawer unit 80 has a single door 82 with a handle 38 and the drawers 26 each have integral handles 84 and each lack the decorative panel 10 of FIGS. 2 and 8. Instead, a larger decorative panel 86 is integrated into the door whose structure is the same as that of the decorative panel 10 of FIG. 1 aside from dimensional differences. If desired, the two drawers may be replaced by fixed shelves open at the front with or without the single door 82. If without, then a cover may replace be used that is equipped with the large decorative panel 86 incorporated and is preferably stowed (when not used to cover the front of the shelves) underneath the unit. A storage compartment for the cover may need to be added.

Figure 25:
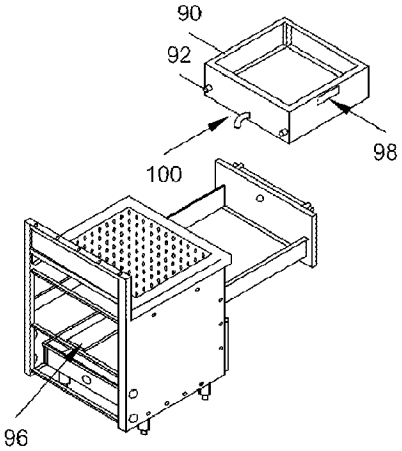
FIG. 25 is an exploded view for the rear, top and side thereof.
Figure 24:
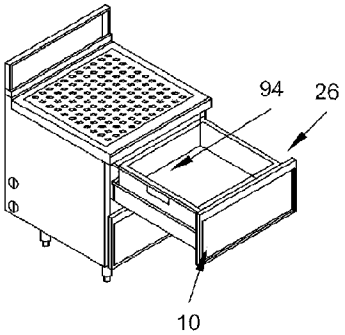
FIG. 24 is an isometric view for the front, top and side of a two-drawer unit with ice bin.
Figure 26:
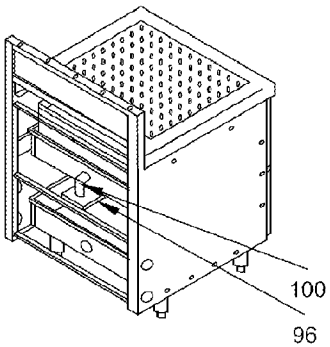
FIG. 26 is an isometric view for the rear, top and side thereof.

Turning to FIGS. 24-26, the two-drawer unit 24 of FIGS. 2 and 8 is shown, but with additional features. These additional features may also be provided to the two-drawer unit 80 of FIGS. 22 and 23 in the same manner. The additional features include a drawer ice insert or drawer ice bin 90, bumpers 92 at the rear of the drawer ice bin 90 to eliminate ice bin movement while in the drawer 26, a drain opening 94 at the bottom of the ice bin 90, a protruding, downwardly directed drain spout 100 from the rear of the ice bin 90 and a drain chute 96 for the drawer ice bin 90 that is positioned to catch liquid from the drain spout 100. The drawer ice bin 90 is equipped with handles 98 for easy removability. The ice drawer bin 90 slides along with the drawer to open and close as required for access to the ice. The drain line from the ice drawer bin 90 will drain into the permanent, non-movable trough (e.g., the drain chute 96) regardless of the drawer's position along a sliding track of the drawer. The trough is pitched to the rear drain, which will have a permanent drain line affixed. Any water that drains from the ice drawer bin 90 will flow to the trough, and then to the drain line.

Figure 27:
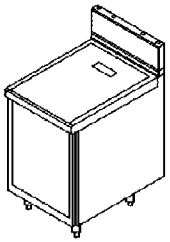
FIG. 27 is an isometric view of the step liquor storage/display unit of FIG. 9, but with an L-shaped cover closing access.
Figure 28:
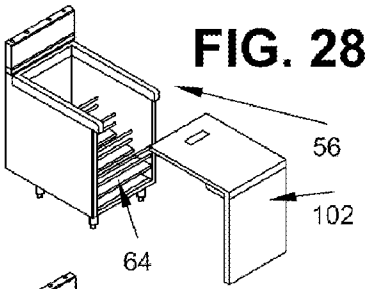
FIGS. 28-29 are progressive isometric views of the step liquor storage/display unit of FIGS. 9 and 27, to show how to remove the L-shaped cover from the orientation of FIG. 27 and the folding the L-shaped cover.
Figure 29:
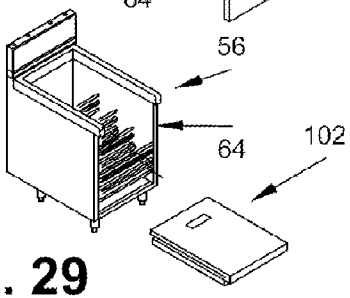
Figure 30:
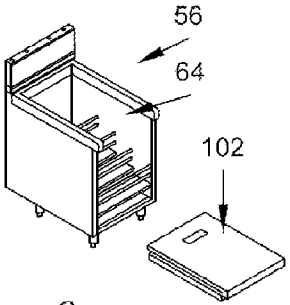
FIGS. 30-31 are progressive isometric views of the step liquor storage/display unit of FIGS. 9 and 27-29, to show how to store the folded L-shaped cover within the footprint of the step liquor storage/display unit as in the orientation of FIG. 9.
Figure 31:
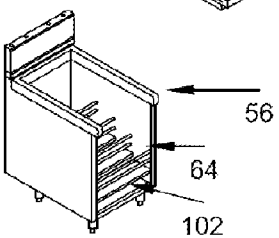

Turning to FIGS. 27-31, the deployment of the L-shaped hinged cover 102 is depicted in various progressive views. The L-shaped hinged cover 102 is hinged and thus may be folded on itself. FIG. 9 shows the L-shaped hinged cover folded and stored away within the footprint of the step liquor storage/display unit 56 and FIG. 27 shows the L-shaped hinged cover 102 unfolded and closing the access cavity 64 to the step liquor storage/display unit 56 where it may be locked in position. By unlocking the L-shaped hinged cover 102, it can be removed as shown in FIG. 28 and then folded upon itself into the position of FIG. 29. Thereafter, the L-shaped hinged cover 102 of FIG. 30 may be inserted into the bottom of the access cavity 64 to be stored within the footprint of the step liquor storage/display unit 56 as shown in FIG. 31.

While the foregoing description and drawings represent the preferred embodiments of the present invention, it will be understood that various changes and modifications may be made without departing from the scope of the present invention.

What is claimed is:

1. A hospitality environment item, comprising:

a plurality of units each arranged side by side so that neighboring ones have surfaces that face each other, each of the units being an underbar furniture/equipment unit selected from the group consisting of an ice bin with cold plate, an ice bin without cold plate, a blender station with a dump sink, a blender station without a dump sink, a step liquor storage display, a hand sink with soap and towel dispenser, a hand sink without a soap and towel dispenser, a drain board, a storage cabinet, a bar sink, a beer dispenser, a filler board, a filler panel, an equipment stand, a wet waste cabinet, a dry waste cabinet, a wet/dry waste cabinet and an ice bin with soda gun;

at least one decorative panel that includes a face bounded by a peripheral edge, the decorative panel having at least one finish selected from the group consisting of laminate, tile, stainless steel, textured stainless steel, bonded metal, solid surface, marble, granite, quartz-based stone, glass, frosted glass, custom graphics, custom logos;

retaining means for retaining the at least one decorative panel in a releasable manner to the underbar furniture/equipment unit;

concealing means for concealing the peripheral edge of the decorative panel, said concealing means including concealing components that conceal the peripheral edge of the decorative panel; and wherein one of the plurality of units is the step liquor storage display as the underbar equipment/furniture unit, the step liquor storage display having a bottom base, a backwall and two sidewalls extending upright from the bottom base, and a cover having two panels hinged to each other to enable the two panels to swing between folded and unfolded orientations, the cover being positioned in to one of a deployed condition, which closes an open front and an open top of the step liquor storage display with the two panels in the unfolded orientation, and a stowed condition, which places the cover on top of the bottom base bounded by the backwall and the two sidewalls with the two panels in the folded orientation.

2. The hospitality environment item of claim 1, wherein the concealing components include a flange having a bend so that a portion of the flange on one side of the bend covers an associated one of the peripheral edges of the at least one decorative panel and a remaining portion of the flange on another side of the bend covers a peripheral region of a face of the at least one decorative panel that neighbors the associated one of the peripheral edges.

3. The hospitality environment item of claim 1, wherein a further one of the plurality of units has a movable element that is movable between different positions; further comprising a lock assembly secured to the movable element and being movable between locking and unlocking positions, the movable element being locked in a retracted position with the lock in the locked position and being movable between the retracted position and an extended position with the lock in the unlocked position.

4. The hospitality environment item of claim 1, wherein the decorative panel covers substantially an entirety of one of the two sidewalls with a remaining one of the two sidewalls lacking the decorative panel.

5. The hospitality environment item of claim 1, wherein the plurality of units includes the bar sink atop an enclosure, the enclosure containing a storage compartment that stores containers of cleaning solution and provide access from outside to the containers in the storage compartment, a dispenser tube assembly that upon actuation dispenses cleaning solution from the containers into the bar sink.

6. The hospitality environment item of claim 1, wherein a further one of the plurality of units includes at least one movable element movable between different positions, the at least one movable element including a door that swings between fully open and closed positions and at least one drawer that is movable between an extended position with the door swung into the fully open position and a retracted position, the door being able to be swung into the closed position provided the drawer is in the retracted position, the decorative panel being integrated with the door.

7. The hospitality environment item of claim 1, wherein a further one of the plurality of units includes at least one movable element that is a drawer movable between extended and retracted positions, the decorative panel being integrated with the drawer.

8. The hospitality environment item of claim 1, wherein a further one of the plurality of units includes a drawer, further comprising a drawer ice bin supported within and by the drawer, the drawer ice bin including a drain opening.

9. The hospitality environment item of claim 1, wherein the decorative panel includes multiple layers including a finish material, said means for retaining the decorative panel in a releasable manner including formations in the multiple layers.

10. The hospitality environment item of claim 1, further comprising hardware selected from the group consisting of door handles, drawer pulls, hinges, slides faucets, fasteners and integrated lights; a further one of the units having a movable element that is movable between different positions, the movable element being selected from the group consisting of a drawer, a door and a removable cover, the movable element having the formations that are in alignment with the formations of the at least one decorative panel, the hardware being retained to the movable element in the releasable manner via aligned ones of the formations.

11. The hospitality environment item of claim 1, wherein the a step liquor storage display has varying height shelves for storage, and a plurality of rods that extend between the two sidewalls, the cover being dimensioned to fit beneath the rods on top of the bottom base in the stowed condition with the two panels in the folded orientation.

12. The hospitality environment item of claim 1, wherein neighboring ones of the plurality of the units have the surfaces that face each other and are positioned adjacent each other so as to conceal from view the surfaces that face each other, the at least one decorative panel being retained to the units clear of the surfaces that face each other so that the surfaces that face each other all lack the at least one decorative panel.

13. A method of assembling a hospitality environment item, comprising:

arranging a plurality of units each arranged side by side so that neighboring ones have surfaces that face each other, each of the units being an underbar furniture/equipment unit, selecting the underbar furniture/equipment unit from the group consisting of an ice bin with cold plate, an ice bin without cold plate, a blender station with a dump sink, a blender station without a dump sink, a step liquor storage display, a hand sink with soap and towel dispenser, a hand sink without a soap and towel dispenser, a drain board, a storage cabinet, a bar sink, a beer dispenser, a filler board, a filler panel, an equipment stand, a wet waste cabinet, a dry waste cabinet, a wet/dry waste cabinet and an ice bin with soda gun;

providing the underbar furniture/equipment unit with a movable element that is movable between different positions, the movable element having and being selected from the group consisting of a drawer, a door and a removable cover;

retaining at least one decorative panel in a releasable manner to the underbar furniture/equipment, the decorative panel including a face bounded by a peripheral edge, the decorative panel having a finish selected from the group consisting of laminate, tile, stainless steel, textured stainless steel, bonded metal, solid surface, marble, granite, quartz-based stone, glass, frosted glass, customized graphics and customized logos;

concealing the peripheral edge of the decorative panel with concealing components that conceal the peripheral edge of the decorative panel;

selecting the step liquor storage display as one of the plurality of units, the step liquor storage display having a bottom base, a backwall and two sidewalls extending upright from the bottom base, and a cover having two panels hinged to each other to enable the two panels to swing between folded and unfolded orientations; and positioning the cover of the step liquor storage display into one of a deployed condition, which closes an open front and an open top of the step liquor storage display with the two panels being in the unfolded orientation, and a stowed condition, which places the cover on top of the bottom base bounded by the backwall and the two sidewalls with the two panels being in the folded orientation.

14. The method of assembling a hospitality environment item of claim 13, wherein the concealing components include a flange having a bend, covering an associated one of the peripheral edges of the at least one decorative panel with a portion of the flange on one side of the bend and covering a peripheral region of a face of the at least one decorative panel that neighbors the associated one of the peripheral edges with a remaining portion of the flange on another side of the bend.

15. The method of assembling the hospitality environment item of claim 13, wherein a further one of the units has a movable element that is movable between different positions, the movable element and the at least one decorative panel having openings; further comprising securing the lock assembly to the movable element, the lock assembly being movable between locking and unlocking positions, the movable element being locked in a retracted position with the lock in the locked position and being movable between retracted and extended positions with the lock in the unlocked position.

16. The method of assembling the hospitality environment item of claim 13, wherein a further one of the plurality of units has a front, a rear, a top, a bottom and two opposite sides, further comprising covering substantially an entirety of at least one of the two opposite sides with the decorative panel, another of the two opposite sides lacking the decorative panel.

17. The method of assembling the hospitality environment item of claim 13, further comprising selecting a further one of the plurality of units to be the bar sink atop an enclosure, the enclosure containing a storage compartment that stores containers of cleaning solution and provides access from outside to the containers in the storage compartment, and arranging a dispenser tube assembly that upon actuation dispenses cleaning solution from the containers into the bar sink.

18. The method of assembling the hospitality item environment item of claim 13, wherein a further one of the plurality of units includes a movable element that is a door that swings between fully open and closed positions, further comprising at least one drawer that moves between an extended position with the door swung into the fully open position and a retracted position, the door being able to be swung into the closed position provided the drawer is in the retracted position, the decorative panel being integrated with the door.

19. The method of assembling the hospitality environment item of claim 13, wherein a further one of the plurality of units includes a movable element that is a drawer that moves between extended and retracted positions, the decorative panel being integrated with the drawer.

20. The method of assembling the hospitality environment item of claim 13, wherein a further one of the plurality of units includes a drawer, further comprising supporting a drawer ice bin within and by the drawer, the ice bin including a drain opening.

21. The method of assembling the hospitality environment item of claim 13, wherein the decorative panel includes two layers of laminate, each of the two layers of the laminate differing from each other with respect to the laminate finish, each of the two layers of laminate having respective formations, aligning the respective formations with each other to carry out said retaining the decorative panel in a releasable manner and said concealing the peripheral edge.

22. The method of assembling the hospitality environment item of claim 13, further comprising selecting hardware from the group consisting of door handles, drawer pulls, faucets, hinges, slides, fasteners and integrated lights, the underbar/furniture having a movable element that is movable between different positions, the movable element being selected from the group consisting of a drawer, a door and a removable cover, the movable element having the formations that are in alignment with the formations of the at least one decorative panel, and retaining the hardware to the movable element in the releasable manner via aligned ones of the formations.

23. The method of assembling the hospitality environment item of claim 13, wherein the step liquor storage display has varying height shelves for storage, and a plurality of rods that extend between the two sidewalls the cover being dimensioned to fit beneath the rods on top of the bottom base in the stowed condition with the two panels in the folded orientation.

24. The method of assembling the hospitality environment item of claim 23, wherein neighboring ones of the plurality of units have the surfaces that face each other and are positioned adjacent each other so as to conceal from view the surfaces that face each other, and retaining the at least one decorative panel to the items clear of the surfaces that face each other so that the surfaces that face each other all lack the at least one decorative panel.

* * * * *